US011510542B2

(12) United States Patent
Chen

(10) Patent No.: US 11,510,542 B2
(45) Date of Patent: Nov. 29, 2022

(54) EXHAUST MOTOR OF VACUUM DEVICE

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 519 days.

(21) Appl. No.: 16/726,614

(22) Filed: Dec. 24, 2019

(65) Prior Publication Data

US 2021/0186288 A1 Jun. 24, 2021

(51) Int. Cl.
*A47L 9/28* (2006.01)
*A47L 5/22* (2006.01)

(52) U.S. Cl.
CPC ..... *A47L 9/2889* (2013.01); *A47L 5/22* (2013.01)

(58) Field of Classification Search
CPC ..... A47L 9/2889; A47L 5/22
See application file for complete search history.

(56) References Cited

U.S. PATENT DOCUMENTS 6,166,462 A 12/2000 Finkenbinder et al.
2002/0140297 A1 10/2002 Volkert et al.
2010/0170057 A1* 7/2010 Lee ..... A47L 9/2884 15/319

FOREIGN PATENT DOCUMENTS

CN 106968970 A 7/2017
EP 1025792 B1 10/2006
TW 428845 U 4/2001

* cited by examiner

*Primary Examiner* — Andrew A Horton
(74) *Attorney, Agent, or Firm* — Muncy, Geissler, Olds & Lowe, P.C.

(57) ABSTRACT

An exhaust motor of vacuum device comprises an electric motor comprising a motor casing and a drive shaft, and an air bucket connected to the electric motor. The air bucket defines an air inlet side and an air outlet side, at least one rotating fan driven by the drive shaft to generate a high-pressure airflow flowing from the air inlet side to the air outlet side is provided in the air bucket. The air bucket is provided with a diversion end plate forming a plurality of diversion passages, each of the diversion passages comprises an inlet and an outlet, and the inlet is located on an original output path of the high-pressure airflow. The diversion passages divert the high-pressure airflow to flow toward the motor casing, and turn the high-pressure airflow into a heat-dissipating airflow capable of exchanging heat with the motor casing.

12 Claims, 9 Drawing Sheets

EXHAUST MOTOR OF VACUUM DEVICE

FIELD OF THE INVENTION

The present invention relates to an exhaust motor of vacuum device, and more particularly to an exhaust motor which can be used in dry and humid environments at the same time by changing an air flow path and the structure of a motor casing.

BACKGROUND OF THE INVENTION

In the existing vacuum device, an electric motor is mainly used to drive at least one rotating fan when the exhaust motor of the vacuum device is operated. When the rotating fan rotates, the central area at the front ends of the fan blades will form a negative pressure area, so that the external air will flow toward the negative pressure area and be drawn into the rotating fan under the effect of pressure difference, and then the air is discharged by centrifugation along the fan blade surfaces. In addition, in order to accurately and effectively control the direction of air flow and simultaneously increase the air diversion rate, the rotating fan is often installs in an air bucket in the existing exhaust motor. A size of an opening on the air bucket and a distance between the opening and the rotating fan are adjusted to change the amount of air inside the air bucket and the negative air pressure value. Further, the side of the air bucket facing the drive shaft is provided with at least one air outlet hole communicating with the outside, and the air outlet hole is used for discharging the air entering the air bucket to the outside.

In addition, the existing exhaust motor is divided into thu-flow exhaust motor that can only be used to suck dry air and by-pass exhaust motor that can be used to suck dry air and humid air according to the disposing location of the air outlet hole. First, the thu-flow exhaust motor is described as follow. The air outlet hole of the thu-flow exhaust motor is provided corresponding to its electric motor. After air enters the air bucket, it will be discharged directly in the direction facing the electric motor. The thu-flow exhaust motor can dissipate heat of the electric motor while discharging the air in the direction of the electric motor, as disclosed in Taiwan patent No. 428845. However, since the air exhausted by the conventional thu-flow exhaust motor directly blows at the electric motor, the conventional thu-flow exhaust motor can only suck air that does not contain a large amount of moisture, which is commonly known as dry air, otherwise it will damage the electric motor due to short circuit caused by humidity. Furthermore, according to the structure disclosed in Taiwan patent No. 428845, it can be found that the electric motor is not provided with a casing, that is, the stator and the rotor of the electric motor are not shielded and are exposed to the outside.

On the other hand, the by-pass exhaust motor is provided with the air outlet hole on one side of the air bucket, as disclosed in U.S. Pat. No. 6,166,462, US 20020140297, CN 106968970A and EP 1025792B1. In addition, when the by-pass type of exhaust motor is implemented, the air entering the air bucket will be discharged to the outside from the side of the air bucket. Although when the by-pass exhaust motor sucks humid air containing a large amount of moisture, short circuit will not happen to the electric motor due to moisture in the humid air; however, for the by-pass exhaust motor, since the air discharged from the air bucket cannot blow toward the electric motor, the heat generated by the operated electric motor cannot be quickly dissipated.

SUMMARY OF THE INVENTION

A main object of the present invention is to solve the problem that the conventional thu-flow exhaust motor can only dissipate heat of its electric motor but cannot be used in a humid environment.

A main object of the present invention is to solve the problem that the conventional by-pass exhaust motor cannot be used to dissipate heat of its electric motor although it can be used in a humid environment.

In order to achieve the above objects, the present invention provides an exhaust motor of vacuum device comprising an electric motor and an air bucket connected to the electric motor. The electric motor comprises a motor casing and a drive shaft. The air bucket defines an air inlet side and an air outlet side facing the electric motor, the air bucket is provided with at least one rotating fan connected to the drive shaft and driven by the drive shaft to generate a high-pressure airflow flowing from the air inlet side to the air outlet side. The air bucket is provided with a diversion end plate which is located at the air outlet side and formed with a plurality of diversion passages, an inlet of each of the diversion passages is located on an original output path of the high-pressure airflow, and an outlet of each of the plurality of diversion passages located on an axes which is different from the inlet, and the outlet close to the motor casing. Each of the diversion passages diverts the high-pressure airflow to flow toward a direction of the motor casing, and turns the high-pressure airflow into a heat-dissipating airflow capable of exchanging heat with the motor casing.

In one embodiment, the diversion end plate comprises a base deflector plate and an airflow divert plate provided on the base deflector plate. The base deflector plate is formed with a plurality of through holes which respectively serve as one of the inlets, and a plurality of diversion grooves provided on a side of the base deflector plate facing the electric motor. The plurality of through holes are located in a projection of the airflow divert plate, and a portion of each of the diversion grooves that is not shielded by the airflow divert plate forms the outlet of each of the diversion passages.

In one embodiment, the inlet of each of the diversion passages is located at an outer side of the diversion end plate.

In one embodiment, the plurality of diversion passages are radially arranged with a center of the diversion end plate as an origin.

In one embodiment, a plurality of heat dissipation fins are formed on the motor casing.

In one embodiment, the motor casing comprises a hollow tube and an end cap provided on one side of the hollow tube.

In one embodiment, a projection portion of each of the plurality of heat dissipation fins located on an outer periphery of the hollow tube is located at the outlet of one of the plurality of diversion passages.

In one embodiment, the electric motor comprises a circuit board horizontally disposed in the hollow tube, a stator disposed on an inner periphery of the hollow tube and assembled with the circuit board, and a rotor disposed in the hollow tube and assembled with the drive shaft.

In one embodiment, the diversion end plate comprises an opening provided for the drive shaft to pass through, and an annular wall surrounding the opening and providing for the hollow tube to be disposed thereon.

In one embodiment, the electric motor comprises a first bearing provided on the end cap and assembled with the drive shaft, and the diversion end plate comprises a second bearing disposed corresponding to the opening and assembled with the drive shaft.

In one embodiment, each of the plurality of diversion passages is provided with a diversion slope at the outlet.

In one embodiment, the air bucket comprises a plurality of rotating fans and at least one stationary fan located between any two of the adjacent rotating fans.

Accordingly, compared with the conventional technique, the present invention has the following features: by changing the airflow path of the exhaust motor and changing the structure of the electric motor at the same time, the exhaust motor is capable of sucking air that does not contain a large amount of moisture (commonly known as dry air) and humid air at the same time. In more detail, through the disposition of the motor casing in the present invention, when the present invention is used to suck humid air, the motor casing shields and seals the internal space so that the humid air cannot enter inside the electric motor. At the same time, the high-pressure airflow is guided by the diversion end plate of the present invention, so that when the high-pressure airflow is discharged from the air outlet side, the high-pressure airflow is diverted and turned into the heat-dissipating airflow flowing toward the motor casing, thereby enabling the heat-dissipating airflow to dissipate heat of the electric motor simultaneously when the heat-dissipating airflow is discharged from the air bucket.

DETAILED DESCRIPTION OF THE PREFERRED EMBODIMENTS

Figure 1:
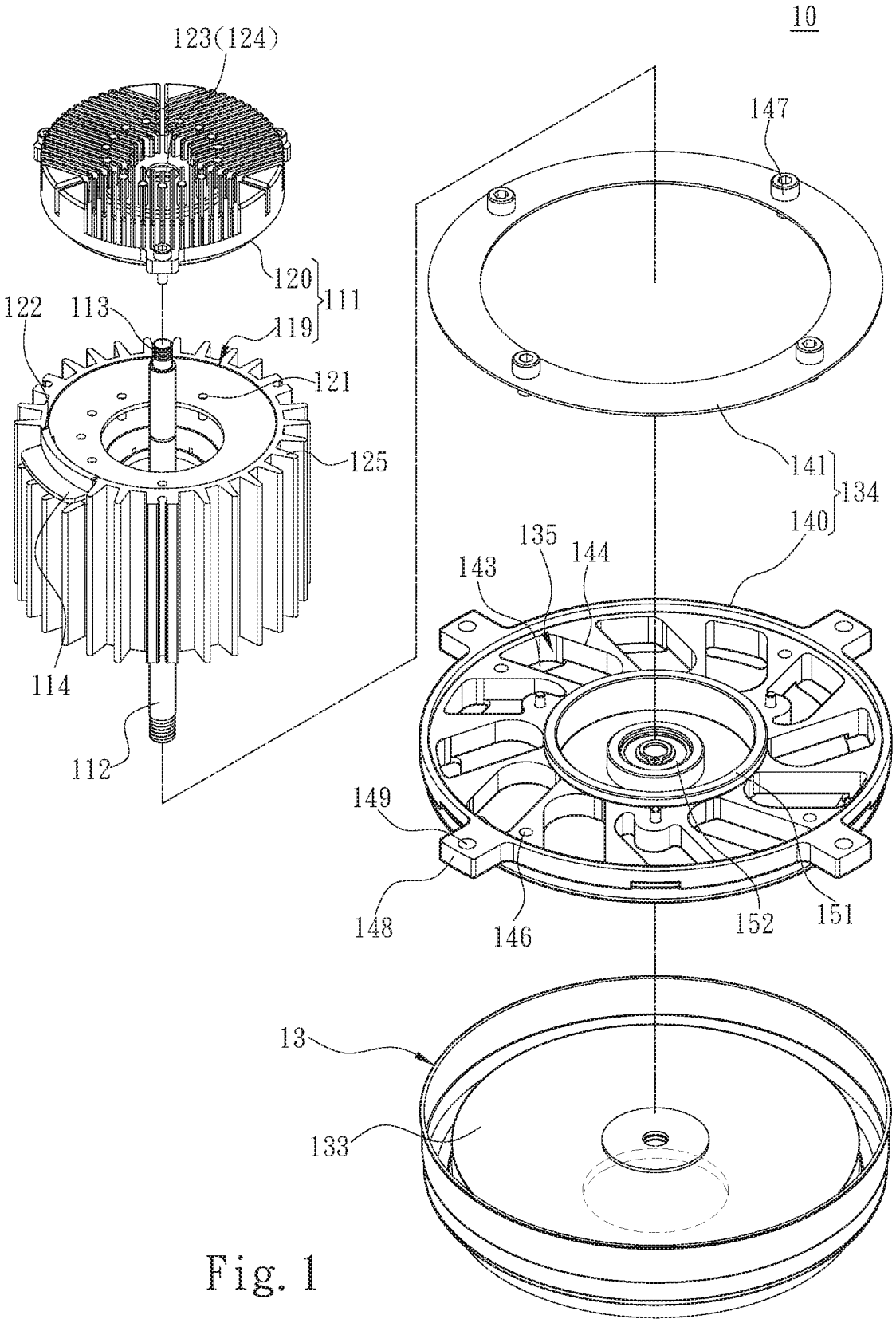
FIG. 1 is an exploded view of the structure of a first embodiment of the present invention.

The detailed description and technical contents of the present invention are described below with reference to the drawings.

In the following, the terms "first" and "second" used in the elements are intended to distinguish the elements and are not intended to limit the order of the elements. In addition, the following spatial terms such as "top end", "bottom edge", "upward" and "downward" are based on the directions in which the figures are drawn. It is understandable that these spatial terms are changed as the directions in which the figures are drawn are changed, for example, once FIG. 1 is drawn horizontally, the original "top end" and "bottom edge" will be changed to "left" and "right" respectively.

Please refer to FIG. 1, FIG. 2, FIG. 3, and FIG. 4. The present invention provides an exhaust motor 10, and the exhaust motor 10 is applied to a vacuum device (not shown in the figures). The vacuum device sucks air that does not contain a large amount of moisture (commonly known as dry air) or humid air containing a large amount of moisture. The exhaust motor 10 comprises an electric motor 11 and an air bucket 13 connected to the electric motor 11. Specifically, the electric motor 11 comprises a motor casing 111 and a drive shaft 112, the motor casing 111 is provided for the drive shaft 112 to pass through, and two ends of the drive shaft 112 are respectively provided with a thread portion 113. In one embodiment, the electric motor 11 comprises a circuit board 114 disposed in the motor casing 111 and provided for the drive shaft 112 to pass through, a rotor 115 disposed in the motor casing 111 and assembled with the drive shaft 112, and a stator 116 connected to the rotor 115 and assembled with the circuit board 114. The stator 116 further comprises a coil 117 assembled with at least one assembly hole 121 of the circuit board 114, and a metal element 118 connected to the coil 117. The metal element 118 is a silicon steel plate known to those ordinarily skilled in the art. The electric motor 11 is driven after receiving a working power and causes the drive shaft 112 to start rotating. In another embodiment, the motor casing 111 comprises a hollow tube 119 and an end cap 120 provided on one side of the hollow tube 119. The hollow tube 119 is provided for the circuit board 114 to be placed horizontally therein. In addition, the hollow tube 119 and the end cap 120 together shield the rotor 115 and the stator 116, so that the rotor 115 and the stator 116 cannot be seen from the top of the electric motor 11. In a further embodiment, the motor casing 111 further comprises a notch 122 disposed on the hollow tube 119 and provided for a part of the circuit board 114 to protrude outside of the hollow tube 119. Furthermore, the motor casing 111 comprises a first bearing 123 disposed on the end cap 120 and assembled with the drive shaft 112. In addition, the motor casing 111 is further provided with a perforation 124 located on a side of the end cap 120 which is not provided with the first bearing 123, and the perforation 124 is provided for the drive shaft 112 to pass through and protrude outside of the motor casing 111.

On the other hand, the air bucket 13 is disposed on one side of the electric motor 11 and is assembled with the motor casing 111. The air bucket 13 defines an air inlet side 131 and an air outlet side 132 facing the electric motor 11. Inside the air bucket 13 is provided with at least one rotating fan 133 connected to the drive shaft 112 and a diversion end plate 134 disposed at the air outlet side 132. The rotating fan 133 is driven by the drive shaft 112 to rotate, and the diversion end plate 134 is assembled with a side of the motor casing 111 which is not provided with the end cap 120, so that the diversion end plate 134 serves as the other end cap 120 of the motor casing 111 and thereby sealing the hollow tube 119. The diversion end plate 134 is formed with a plurality of diversion passages 135, for example, the plurality of diversion passages 135 are spaced apart from each other and are spirally and radially arranged with a center of the diversion end plate 134 as an origin. In addition, each diversion passage 135 comprises an inlet 136 and an outlet 137, the inlet 136 and the outlet 137 of each diversion passage 135 are respectively located on different vertical axes 138 and 139; more specifically, in each diversion passage 135, the outlet 137 is located at a position near the motor casing 111, and the inlet 136 is located at an outer side of the diversion passage 135.

Figure 2:
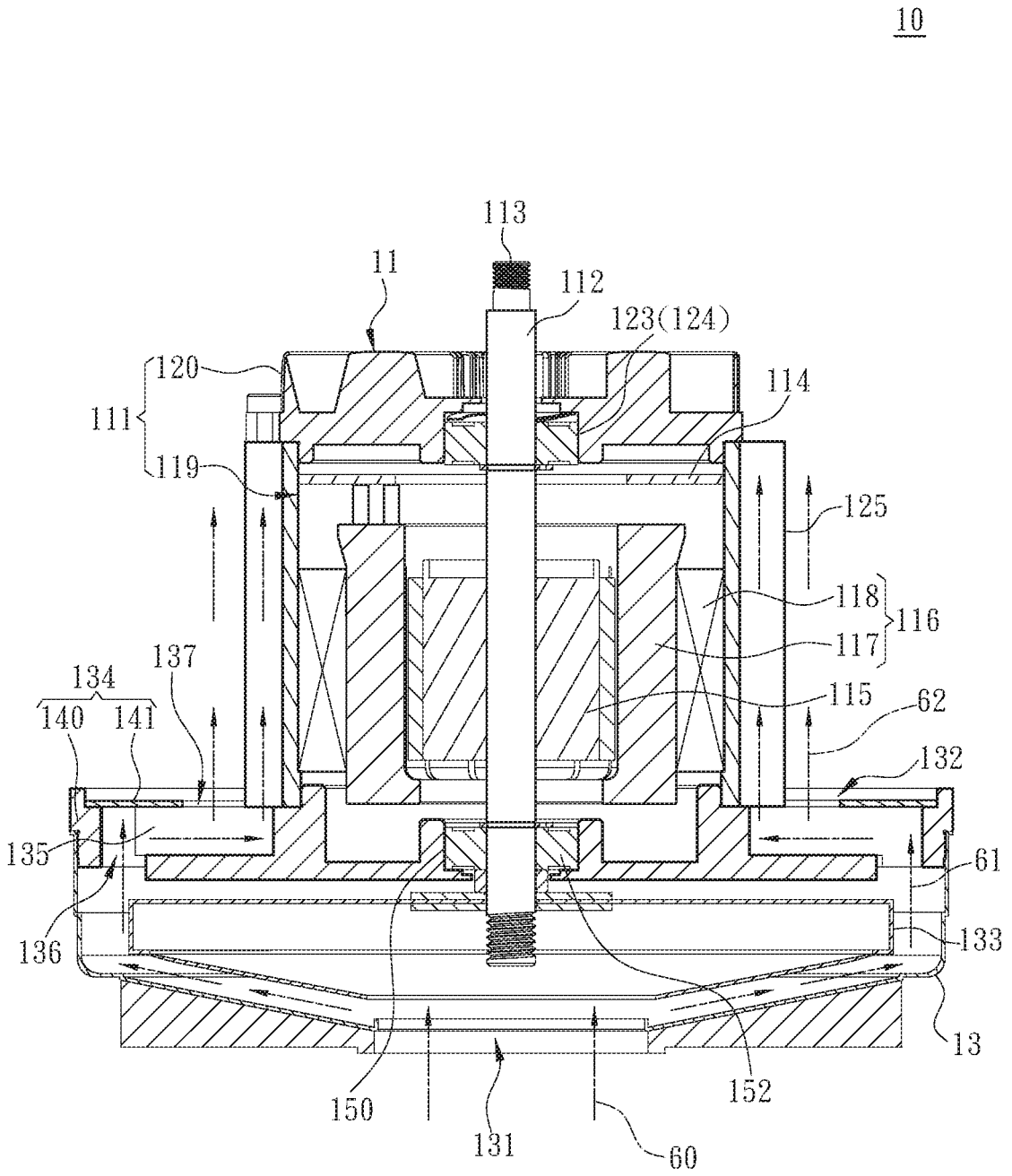
FIG. 2 is a schematic diagram of air flow directions of the first embodiment of the present invention.

Then, please refer to FIG. 1 and FIG. 2, which illustrates the implementation of the exhaust motor 10. Initially, the exhaust motor 10 receives the working power and drives the drive shaft 112 to start operating. At this time, since the air bucket 13 is affected by the rotation of the rotating fan 133, a negative pressure area is generated at the air inlet side 131, and an external airflow 60 located in the negative pressure area enters into the air bucket 13 due to negative air pressure. Thereafter, the external airflow 60 is driven by the rotating fan 133, so that the external airflow 60 centrifugally accelerates along a surface of the rotating fan 133 and flows toward an outer edge of the rotating fan 133. At this time, the external airflow 60 is pressurized by centrifugation and turned into a high-pressure airflow 61. The high-pressure airflow 61 located at the outer edge of the rotating fan 133 hits an inner wall of the air bucket 13 to cause the high-pressure airflow 61 to divert. In addition, the inlet 136 of each diversion passage 135 is located on an original output path of the high-pressure airflow 61, that is, the high-pressure airflow 61 directly flows along an inner wall surface of the air bucket 13 to each of the inlets 136 respectively, and then entering the diversion passages 135 respectively. The high-pressure airflow 61 is continuously guided by the diversion passage 135 and flows toward a direction of the outlet 137, the high-pressure airflow 61 at the outlet 137 is guided by the diversion passage 135 to divert, and the diverted high-pressure airflow 61 is turned into a heat-dissipating airflow 62. The heat-dissipating airflow 62 flows toward a direction facing the motor casing 111 and exchanges heat with the motor casing 111.

According to the above-mentioned description, by changing the airflow path of the exhaust motor 10 and the structure of the electric motor 11 at the same time, the exhaust motor 10 sucks air that does not contain a large amount of moisture (commonly known as dry air) and humid air containing a large amount of moisture at the same time. In more detail, through a disposition of the motor casing 111, when the present invention sucks humid air, the motor casing 111 shields and seals the internal space so that the humid air cannot enter inside the electric motor 11. At the same time, the high-pressure airflow 61 is guided by the diversion end plate 134, so that when the high-pressure airflow 61 is discharged from the air outlet side 132, the high-pressure airflow 61 is diverted and turned into the heat-dissipating airflow 62 flowing toward the motor casing 111. Thus, the heat-dissipating airflow 62 is able to dissipate the heat of the electric motor 11 simultaneously when the heat-dissipating airflow 62 is discharged from the air bucket 13.

Figure 3:
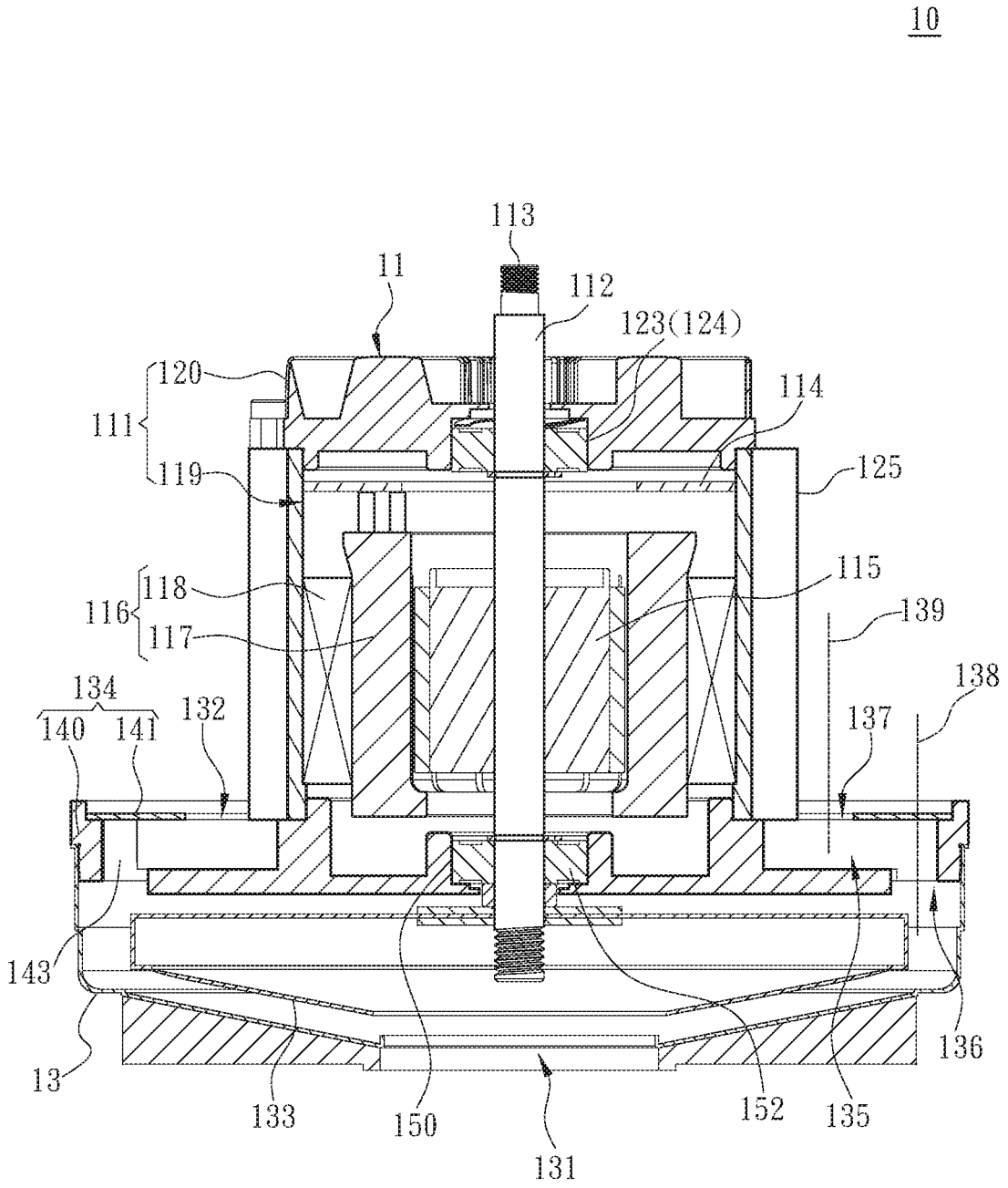
FIG. 3 is a cross-sectional view of the structure of the first embodiment of the present invention.
Figure 4:
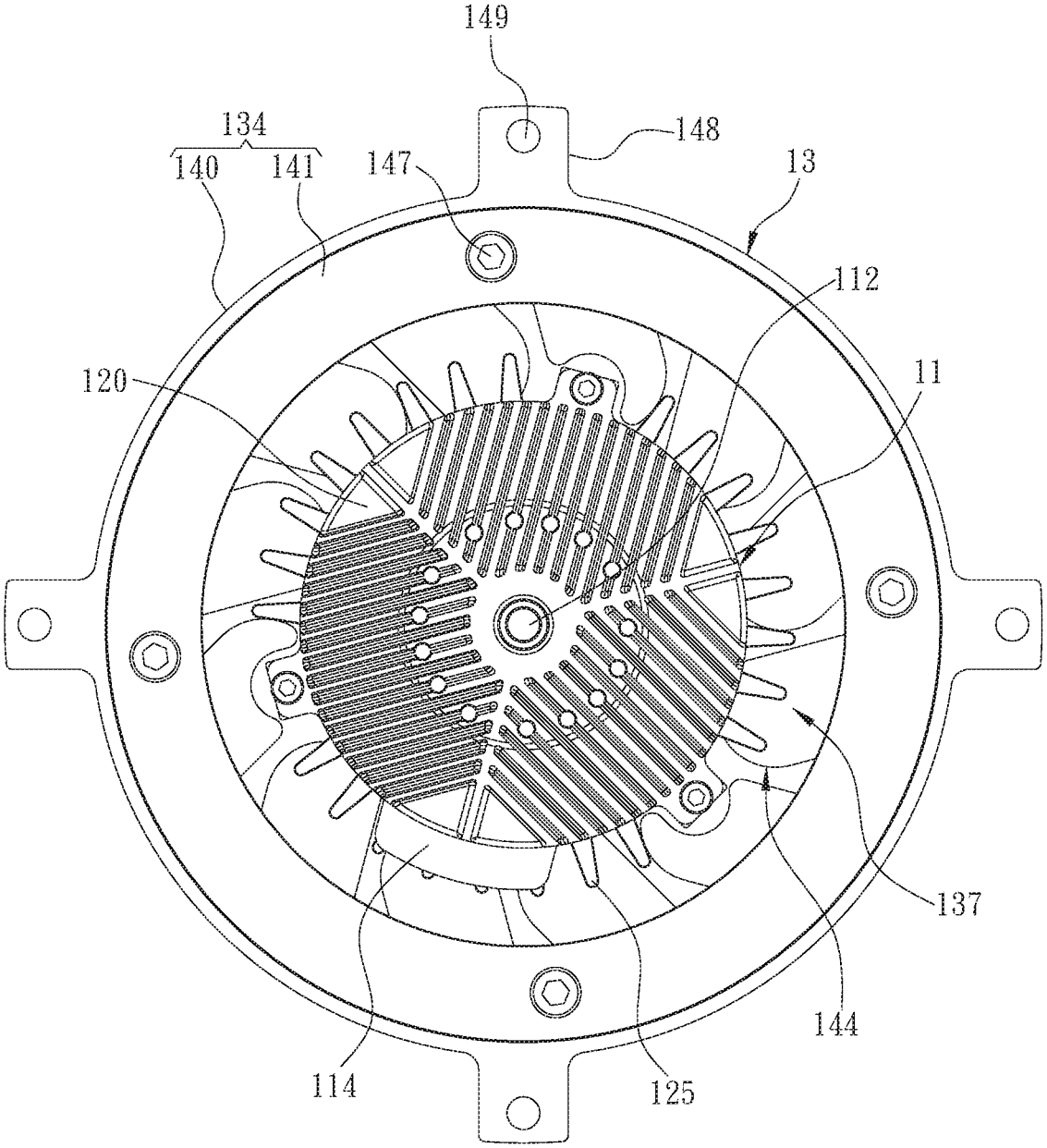
FIG. 4 is a top view of an exhaust motor of the first embodiment of the present invention.
Figure 5:
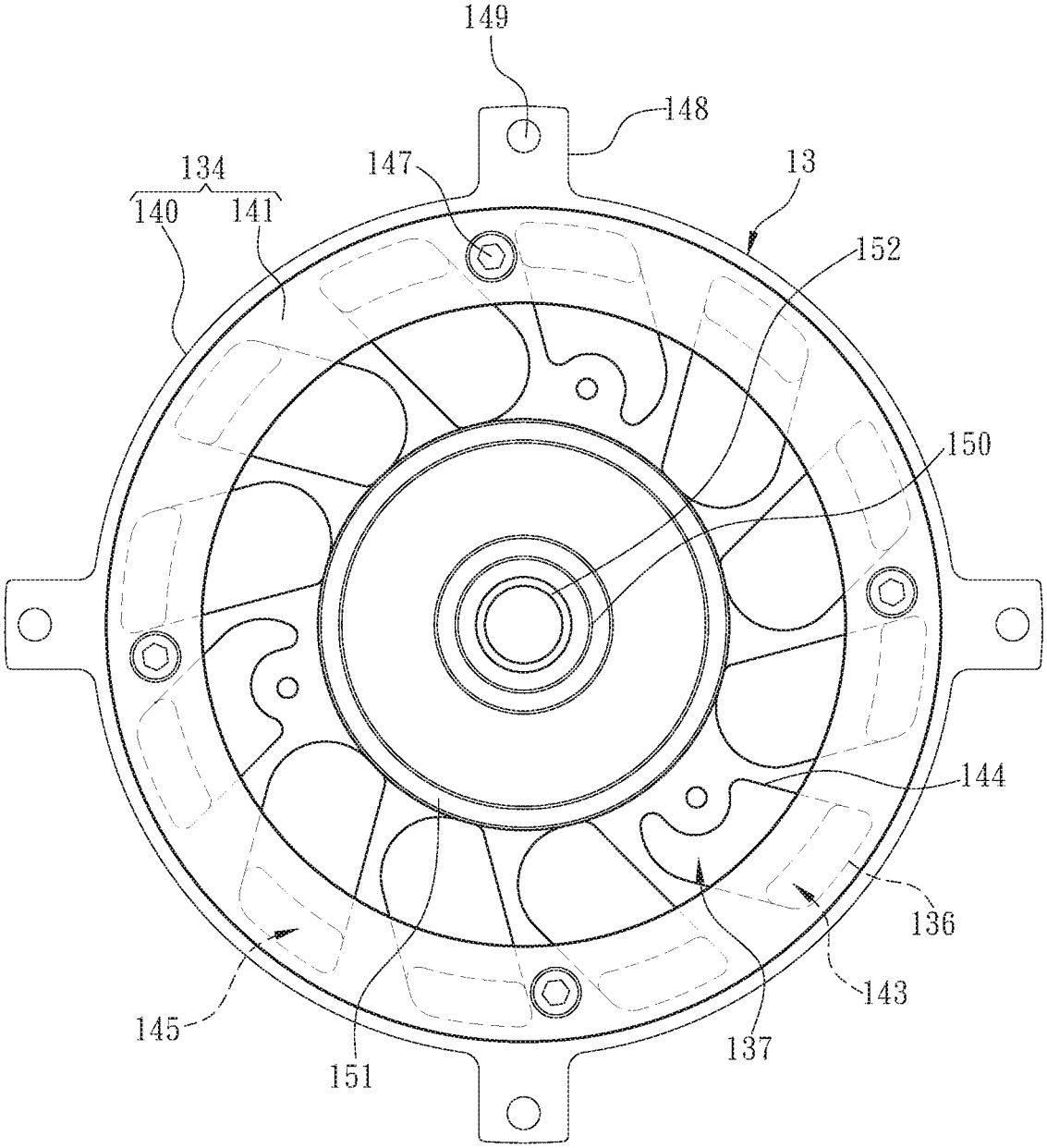
FIG. 5 is a top view of a diversion end plate of the first embodiment of the present invention.

Please refer to FIG. 1, FIG. 2, FIG. 3, FIG. 4, and to FIG. 5. In one embodiment, the diversion end plate 134 comprises a base deflector plate 140 and an airflow divert plate 141 provided on the base deflector plate 140. Specifically, the base deflector plate 140 is formed with a plurality of through holes 143 which respectively serve as one of the plurality of inlets 136, and a plurality of diversion grooves 144 provided on a side of the base deflector plate 140 facing the electric motor 11. The plurality of through holes 143 are located in a projection of the airflow divert plate 141 which is shown as 145 in FIG. 5. In addition, the airflow divert plate 141 is an annular structure, that is, the airflow divert plate 141 does not completely shield the base deflector plate 140. An unshielded portion of each diversion groove 144 forms the outlet 137 of each diversion passage 135. In other words, the portion of each diversion groove 144 that is not shielded by the airflow divert plate 141 determines the size of the outlet 137 of each diversion passage 135. If a shielded portion of each diversion groove 144 is increased, the area of the outlet 137 is reduced toward a direction facing to the motor casing 111, so that the heat-dissipating airflow 62 is guided by the airflow divert plate 141 to be closer to the motor casing 111. Conversely, when the shielded portion of each diversion groove 144 is decreased, the heat-dissipating airflow 62 is relatively opposite to the motor casing 111. Furthermore, in one embodiment, in order to ensure that the airflow divert plate 141 and the base deflector plate 140 are stably assembled, the base deflector plate 140 is formed with at least one assembly hole 146, and the airflow divert plate 141 is provided with at least one assembly member 147 to assemble with the assembly hole 146. In addition, the base deflector plate 140 comprises at least one lug 148 provided on an outer periphery and protruding opposite to the electric motor 11, and at least one mounting hole 149 provided on the lug 148. Through the disposition of the mounting hole 149, the base deflector plate 140 is capable of assembling on the vacuum device.

Please refer to FIG. 3, FIG. 4, and FIG. 5. In one embodiment, the diversion end plate 134 is provided for the drive shaft 112 to pass through. The diversion end plate 134 comprises an opening 150 provided for the drive shaft 112 to pass through, and an annular wall 151 surrounding the opening 150 and provided for the hollow tube 119 to be disposed on the annular wall 151. In more detail, the opening 150 is formed at a central position of the diversion end plate 134, and the diversion end plate 134 controls a position of the drive shaft 112 disposing in the opening 150. The diversion end plate 134 is further provided with a second bearing 152 in the opening 150, and the second bearing 152 is assembled with the drive shaft 112. By disposing the second bearing 152, the drive shaft 112 is capable of reducing friction between the drive shaft 112 and the diversion end plate 134 during. In addition, the diversion end plate 134 reliably seals the hollow tube 119, so that an outer diameter of the annular wall 151 corresponds to an inner diameter of the hollow tube 119, causing the annular wall 151 to contact with an inner wall surface of the hollow tube 119 and to assemble with and seal the hollow tube 119 at the same time, thereby moisture in the heat-dissipating airflow 62 will not enter into the hollow tube 119.

On the other hand, please refer to FIG. 3, FIG. 4, and FIG. 5. In one embodiment, in order to guide the heat-dissipating airflow 62 to flow toward a direction of the motor casing 111, a plurality of heat dissipation fins 125 are formed on the motor casing 111. The heat dissipation fins 125 are radially arranged with a center of the motor casing 111 as an origin, and an extending direction of each of the heat dissipation fins 125 is parallel to an extending direction of the hollow tube 119. A projection portion of each of the heat dissipation fins 125 is located at the outlet 137 of one of the diversion passages 135, so that the heat-dissipating airflow 62 discharged from the outlet 137 is capable of flowing along one of the heat dissipation fins 125 toward a direction opposite to the outlet 137. To further explain, during the process of the heat-dissipating airflow 62 flowing toward a direction opposite to the outlet 137, in addition to the heat-dissipating airflow 62 guided by one of the plurality of heat dissipation fins 125, the heat-dissipating airflow 62 is further restricted by the heat dissipation fins 125 adjacent to the one of the heat dissipation fin 125. Thus, the heat-dissipating airflow 62 is capable of reliably flowing toward a direction opposite to the outlet 137.

Figure 6:
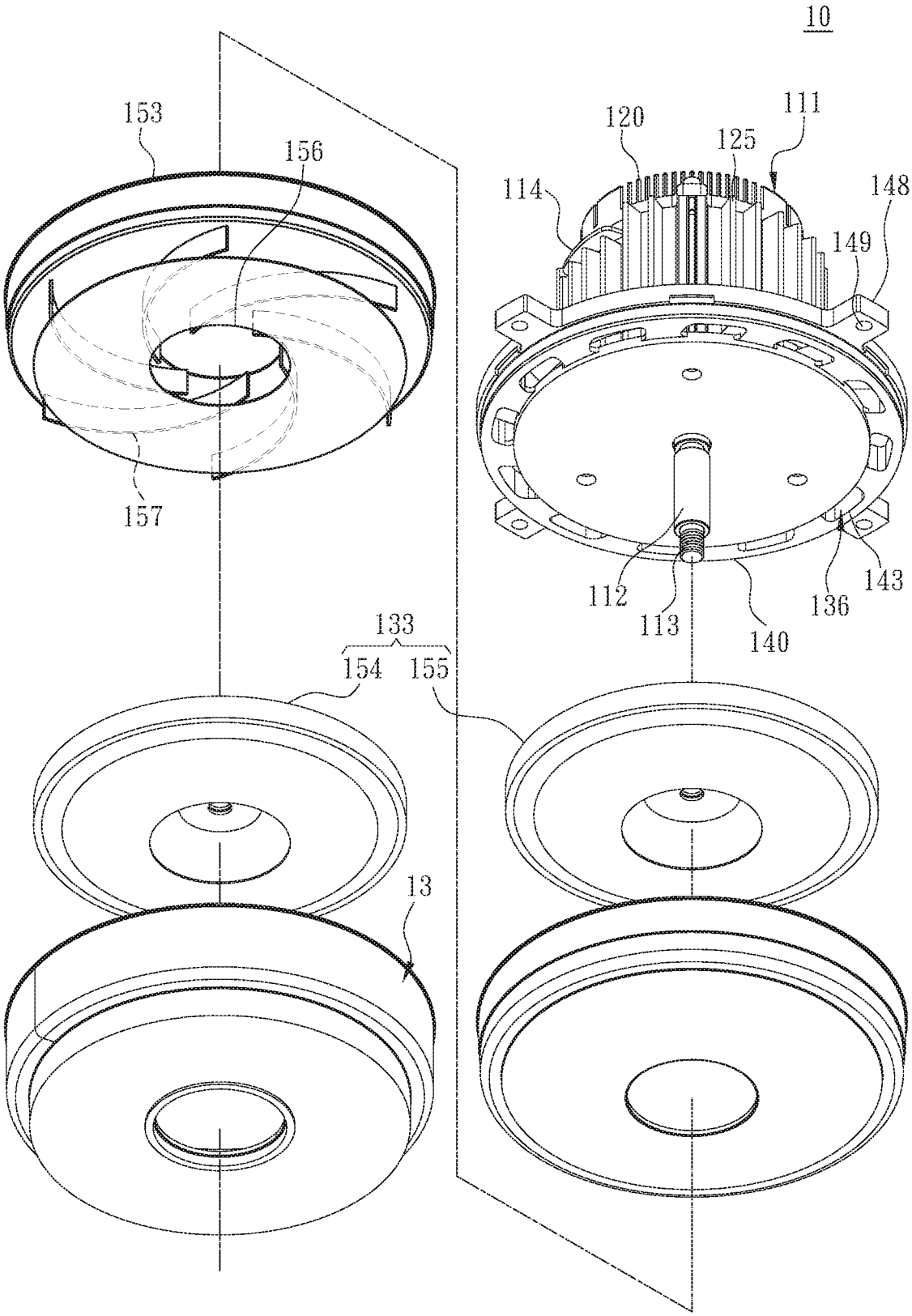
FIG. 6 is an exploded view of the structure of a second embodiment of the present invention.
Figure 7:
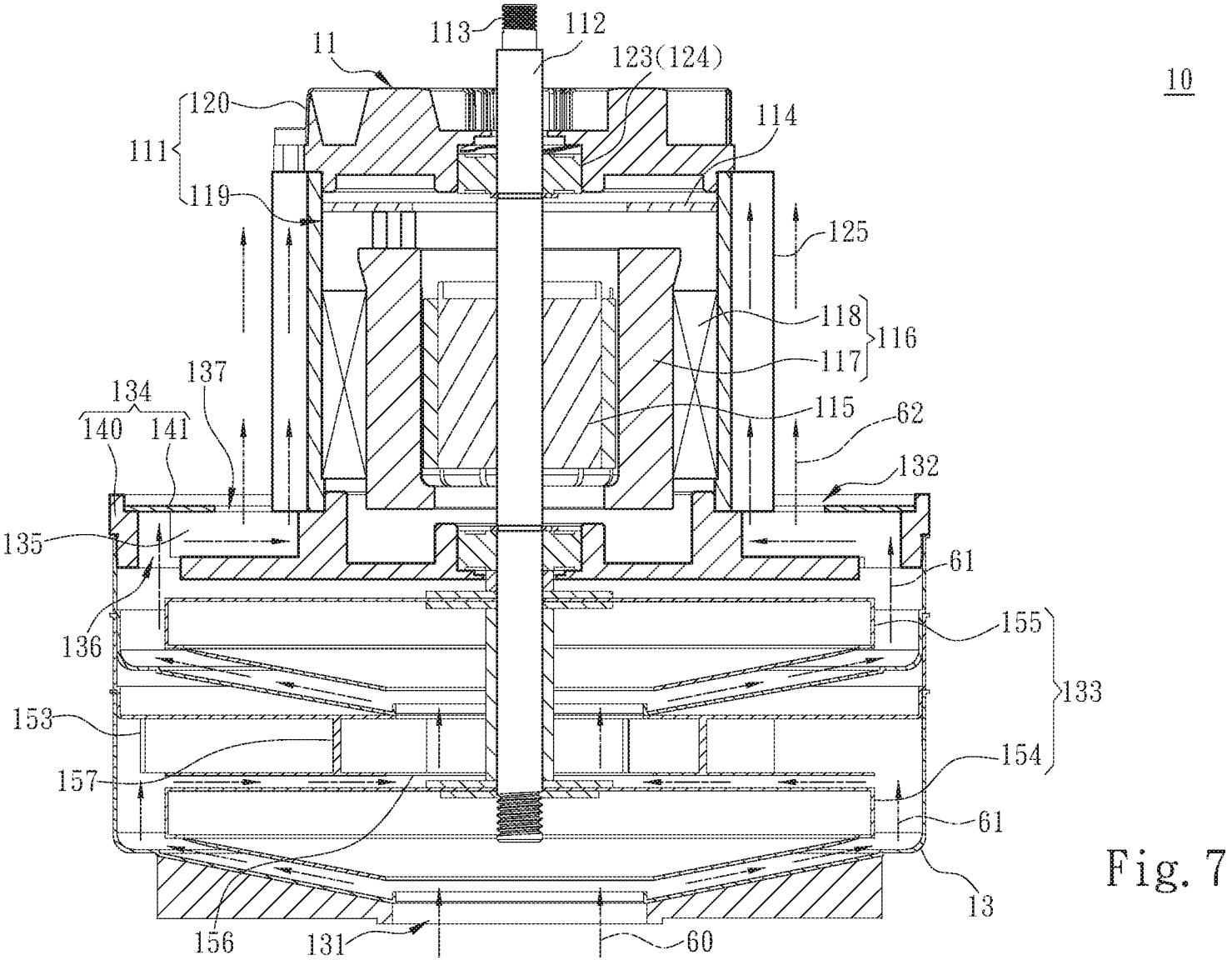
FIG. 7 is a schematic diagram of air flow directions of the second embodiment of the present invention.
Figure 8:
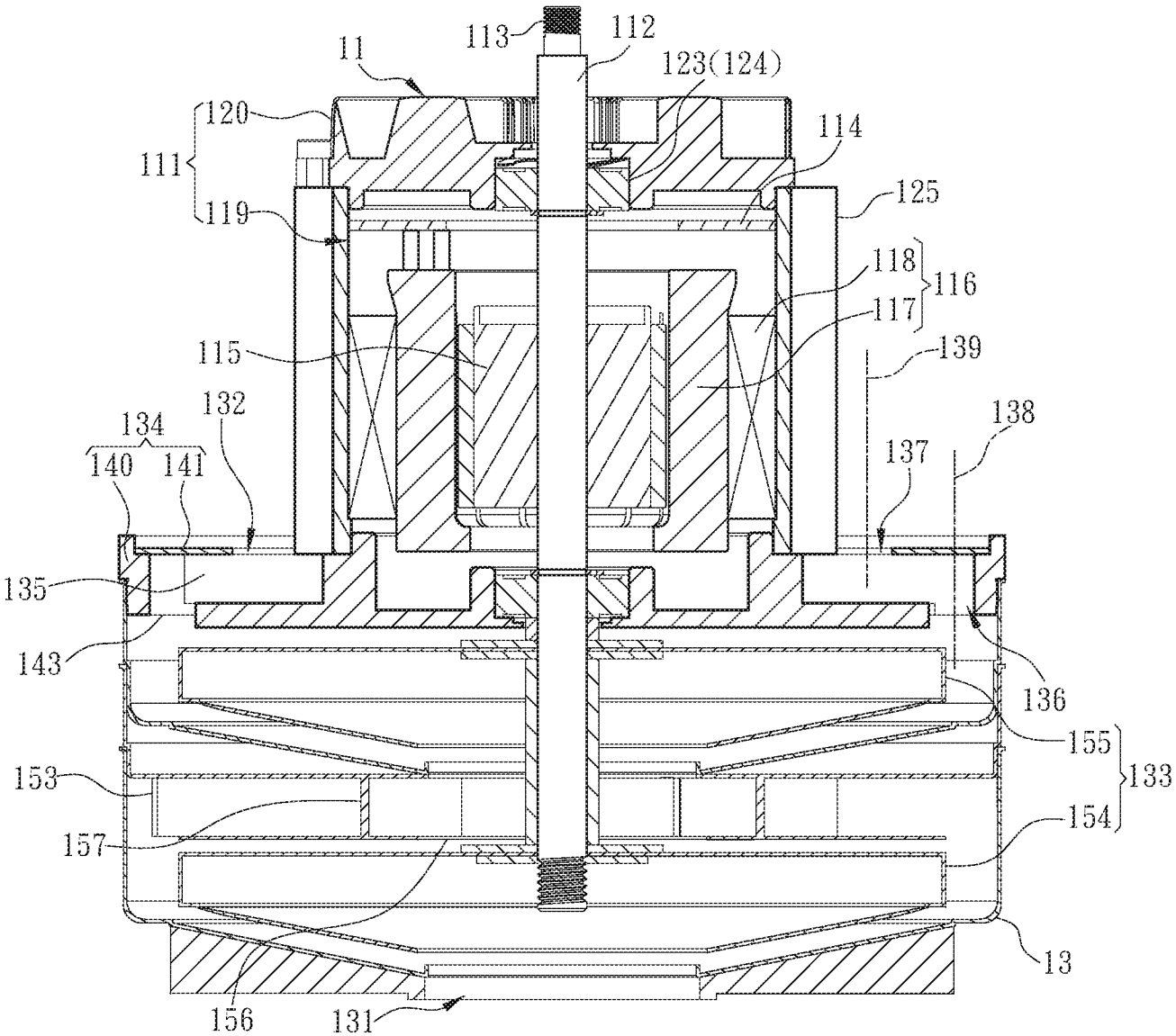
FIG. 8 is a cross-sectional view of the structure of the second embodiment of the present invention.

On the other hand, please refer to FIG. 6, FIG. 7, and FIG. 8. In another embodiment, in order to increase the pressurization effect of the air bucket 13, the plurality of rotating fans 133 and at least one stationary fan 153 disposed between any two of the adjacent rotating fans 133 are provided in the air bucket 13. Taking the embodiment as an example, two rotating fans 133, and a stationary fan 153 disposed between the two rotating fans 133 are provided in the air bucket 13. In addition, the present invention differentiates the two rotating fans 133 into a first rotating fan 154 facing the air inlet side 131, and a second rotating fan 155 facing the air outlet side 132. Furthermore, the stationary fan 153 comprises a thru-hole 156 provided for the high-pressure airflow 61 to pass through. The first rotating fan 154 and the second rotating fan 155 are driven by the drive shaft 112 at the same time to rotate relative to the stationary fan 153, so that the external airflow 60 is affected by the first rotating fan 154 and the second rotating fan 155 to enter the air bucket 13 from the air inlet side 131. Then, the first rotating fan 154 drives the external airflow 60 to flow along a surface of the first rotating fan 154, and the external airflow 60 is accelerated to flow toward an outer edge of the first rotating fan 154 by centrifugation at the same time. After the external airflow 60 is pressurized for the first time, the external airflow 60 is turned into the high-pressure airflow 61. Then, the stationary fan 153 guides and diverts the high-pressure airflow 61 to flow from the first rotating fan 154 toward the second rotating fan 155 via the thru-hole 156, and the second rotating fan 155 also drives the high-pressure airflow 61 to flow centrifugally along the surface of the second rotating fan 155, thereby causing the high-pressure airflow 61 to be pressurized for the second time. After that, the high-pressure airflow 61 pressurized for two times flows out from the air outlet side 132 and diverts to turn into the heat-dissipating airflow 62, so that the heat-dissipating airflow 62 is capable of exchanging heat with the motor casing 111. According to the above-mentioned description, the present invention pressurizes the high-pressure airflow 61 by each of the rotating fans 133. When the present invention is provided with the rotating fans 133, the pressurization effect of the high-pressure airflow 61 is accumulated. Furthermore, in one embodiment, the stationary fan 153 is disposed with at least one diversion structure 157, and the diversion structure 157 is spirally and radially arranged with the thru-hole 156 as a center, thereby guiding the high-pressure airflow 61 to flow toward a direction of the thru-hole 156.

Figure 9:
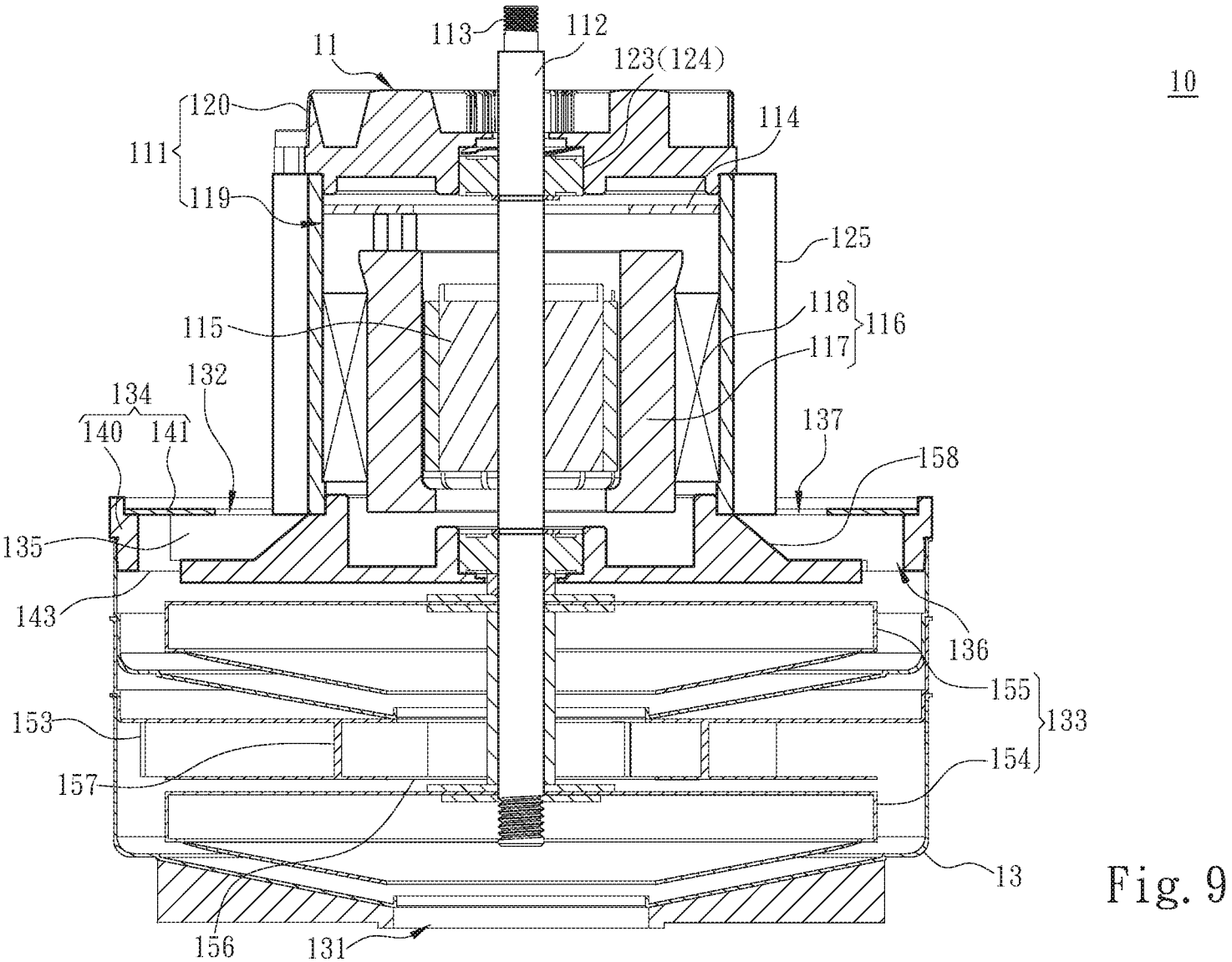
FIG. 9 is a cross-sectional view of the structure of a third embodiment of the present invention.

On the other hand, please refer to FIG. 9. In another embodiment of, each diversion passage 135 is provided with a diversion slope 158 at the outlet 137. More specifically, a side of the diversion slope 158 facing the inlet 136 is a low point, and a side of the diversion slope 158 facing the outlet 137 is a high point. During implementation, the side of the diversion slope 158 facing the inlet 136 receives the high-pressure airflow 61 and the high-pressure airflow 61 flows thereon, and causes the high-pressure airflow 61 to flow along the diversion slope 158 toward a direction facing the outlet 137, thereby when the high-pressure airflow 61 flows out the outlet 137, the high-pressure airflow 61 is capable of flowing toward a direction of the motor casing 111.

What is claimed is:

1. An exhaust motor of vacuum device comprising:

an electric motor comprising a motor casing and a drive shaft; and an air bucket, connected to the electric motor and defining an air inlet side and an air outlet side facing the electric motor, the air bucket provided with at least one rotating fan which is connected to the drive shaft and driven by the drive shaft to generate a high-pressure airflow flowing from the air inlet side to the air outlet side, and the air bucket provided with a diversion end plate which is located at the air outlet side and formed with a plurality of diversion passages, an inlet of each of the plurality of diversion passages located on an original output path of the high-pressure airflow, an outlet of each of the plurality of diversion passages located on an axes which is different from the inlet, and the outlet close to the motor casing, each of the plurality of diversion passages diverting the high-pressure airflow to flow toward a direction of the motor casing, and turning the high-pressure airflow into a heat-dissipating airflow capable of exchanging heat with the motor casing.

2. The exhaust motor of vacuum device as claimed in claim 1, wherein the diversion end plate comprises a base deflector plate and an airflow divert plate provided on the base deflector plate, the base deflector plate is formed with a plurality of through holes which respectively serve as one of the inlets, and a plurality of diversion grooves provided on a side of the base deflector plate facing the electric motor, the plurality of through holes are located in a projection of the airflow divert plate, and a portion of each of the plurality of diversion grooves that is not shielded by the airflow divert plate forms the outlet of each of the plurality of diversion passages.

3. The exhaust motor of vacuum device as claimed in claim 1, wherein the inlet of each of the plurality of diversion passages is located at an outer side of the diversion end plate.

4. The exhaust motor of vacuum device as claimed in claim 1, wherein the plurality of diversion passages are radially arranged with a center of the diversion end plate as an origin.

5. The exhaust motor of vacuum device as claimed in claim 1, wherein a plurality of heat dissipation fins are formed on the motor casing.

6. The exhaust motor of vacuum device as claimed in claim 5, wherein the motor casing comprises a hollow tube and an end cap provided on one side of the hollow tube.

7. The exhaust motor of vacuum device as claimed in claim 6, wherein a projection portion of each of the plurality of heat dissipation fins located on an outer periphery of the hollow tube is located at the outlet of one of the plurality of diversion passages.

8. The exhaust motor of vacuum device as claimed in claim 7, wherein the electric motor comprises a circuit board horizontally disposed in the hollow tube, a stator disposed on an inner periphery of the hollow tube and assembled with the circuit board, and a rotor disposed in the hollow tube and assembled with the drive shaft.

9. The exhaust motor of vacuum device as claimed in claim 8, wherein the diversion end plate comprises an opening provided for the drive shaft to pass through, and an annular wall surrounding the opening and providing for the hollow tube to be disposed thereon.

10. The exhaust motor of vacuum device as claimed in claim 9, wherein the electric motor comprises a first bearing provided on the end cap and assembled with the drive shaft, and the diversion end plate comprises a second bearing disposed corresponding to the opening and assembled with the drive shaft.

11. The exhaust motor of vacuum device as claimed in claim 1, wherein each of the plurality of diversion passages is provided with a diversion slope at the outlet.

12. The exhaust motor of vacuum device as claimed in claim 1, wherein the air bucket comprises a plurality of rotating fans and at least one stationary fan located between any two of the adjacent rotating fans.

* * * * *